US010525362B2

(12) United States Patent
Vicente

(10) Patent No.: US 10,525,362 B2
(45) **Date of Patent: *Jan. 7, 2020**

(54) INFLATABLE SURFING APPARATUS AND METHOD

(71) Applicant: Whitewater West Industries Ltd., Richmond (CA)

(72) Inventor: Oriol Vicente, San Diego, CA (US)

(73) Assignee: WHITEWATER WEST INDUSTRIES LTD., INC, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/238,094

(22) Filed: Aug. 16, 2016

(65) Prior Publication Data

US 2016/0354700 A1 Dec. 8, 2016

Related U.S. Application Data

(63) Continuation of application No. 14/528,801, filed on Oct. 30, 2014, now Pat. No. 9,463,390.

(60) Provisional application No. 61/897,696, filed on Oct. 30, 2013.

(51) Int. Cl.

| | |
|---|---|
| ***A63G 31/00*** | (2006.01) |
| ***A63G 21/18*** | (2006.01) |
| ***B63B 35/85*** | (2006.01) |

(52) U.S. Cl.

CPC ..... *A63G 31/007* (2013.01); *A63G 21/18* (2013.01); *B63B 2035/855* (2013.01)

(58) Field of Classification Search

CPC ..... A63G 31/007; A63G 31/00; A63B 21/18; A63B 21/00; A63B 3/00; B63B 2030/855; E04H 4/0006

See application file for complete search history.

(56) References Cited

U.S. PATENT DOCUMENTS

| | | | | |
|---|---|---|---|---|
| 5,628,584 | A * | 5/1997 | Lochtefeld | A63B 69/0093 405/52 |
| 6,223,673 | B1 * | 5/2001 | Mears | A63B 5/11 114/264 |
| 2002/0056157 | A1 * | 5/2002 | Lochtefeld | E04H 4/0006 4/491 |
| 2003/0004003 | A1 * | 1/2003 | Lochtefeld | A63B 69/0093 472/117 |

(Continued)

*Primary Examiner* — Michael D Dennis

(74) *Attorney, Agent, or Firm* — Buchalter, a professional corp.

(57) ABSTRACT

A water or other amusement attraction that includes an inflatable portion or material. A cavity of the attraction is located underneath an upper surface, the upper surface configured to support a flow of water and at least one rider thereon. A volume of water is configured to be disposed within the cavity, the upper surface floating upon the volume of water while connected to at least one side wall, floor, and/or nozzle structure. A pump and nozzle assembly, positioned outside of the cavity, communicates with the water within the cavity for flowing a portion of the water over the upper surface. A drainage portion, adjacent to the upper surface, drains the flowing water back into the cavity for recirculation. Support components, such as a plurality of beams or an inflatable grid structure help maintain stability for the attraction.

18 Claims, 13 Drawing Sheets

(56) References Cited

U.S. PATENT DOCUMENTS

| | | | | |
|---|---|---|---|---|
| 2009/0169305 | A1* | 7/2009 | Lochtefeld | A63G 31/007 405/79 |
| 2011/0143846 | A1* | 6/2011 | Davis | A63C 19/00 472/128 |
| 2014/0357387 | A1* | 12/2014 | Murphy | A63G 21/18 472/117 |
| 2015/0057093 | A1* | 2/2015 | Murphy | E04H 4/0006 472/128 |

* cited by examiner

INFLATABLE SURFING APPARATUS AND METHOD

CROSS REFERENCE TO RELATED APPLICATIONS

This application is a continuation of Nonprovisional patent application Ser. No. 14/528,801, filed on Oct. 30, 2014, which claims the benefit of U.S. Provisional Patent Application Ser. No. 61/897,696, filed on Oct. 30, 2013.

BACKGROUND

1. Field

The present invention relates generally to amusement attractions, such as surfing simulators or other wave machines. More particularly, the present invention relates to mobile or permanently installed water or surfing attractions that incorporate one or more inflatable sections or areas.

2. Description of the Related Art

Water attractions (e.g., waterslides, surfing slides or machines, boogie-boarding slides, etc.) are a popular entertainment activity during periods of warm weather. Conventional water attractions are commonly made of fiberglass or other rigid or semi-rigid materials that provide a smooth and slippery surface for supporting a flow of water thereon to transport a rider from an entrance to an exit. A variety of different types of ride vehicles (e.g., inner tubes, body boards, surf boards, floatation devices, etc.) may be used by the rider as the rider travels along the water attraction and support the rider as the ride vehicle slides along the riding surface.

One type of water attraction that has proven a popular lure for patrons to water or other amusement parks or venues is the surfing machine or simulator. These machines may be used both for entertainment purposes as well as training purposes for helping instruct individuals that may be wary or otherwise unable to surf out in the open ocean. Conventional surf machines utilize water pumps cooperating with nozzles or jets to flow a sheet or layer of water over a variety of surfaces and allow riders to skim atop the water flow. A riding surface of the conventional surf machine is typically a rigid or semi-rigid, low-friction surface that supports maneuvering by riders upon a conventional or modified surfboard or boogie board (individually and collectively referred to as a "board"). However, users without much surfing experience, either in the ocean or upon surfing machines, commonly fall off of the board during initial attempts at using the surfing machine and the surfaces of these apparatuses can make uncomfortable contact with a rider upon the rider's falling off of their board.

Particularly at competition or sports venues (e.g., surfing competitions, BMX competitions, etc.) located outdoors, such as at or near the beach, surfing simulators have increasingly been in demand as a fun and revenue-generating activity for potential patrons. Surfing simulators also provide onlookers with an additional activity to engage in while present at the venue or event. Unfortunately, given the relatively short duration that many competitions extend, some lasting only a few days in duration, permanent installation of surfing simulators at those locations is not feasible. While some mobile surfing simulators have been developed, the comparably long and typically complex assembly and/or disassembly procedures, oftentimes taking greater time than the entire duration of the event itself, makes such devices undesirable to many potential event holders or organizers. These conventional simulators commonly utilize a large number of component parts that require vast numbers of shipment containers for their assembly, adding significantly to the cost associated with transporting and assembling the simulators at a desired geographic location.

As the sheet flow or standing wave product (collectively "surfing machine") market becomes more popular, water venues increasingly look to new surfing machines that can provide novel experiences to riders or that are less expensive or time consuming to install. Moreover, as the surfing industry becomes more sophisticated and the influence of extreme sports becomes more popular, more extreme standing waves created by such surfing machines are desired in order to satisfy the thrill anticipated by these new generation of users, both adults and children alike. As new surfing machines are developed, maneuverability, rider comfort, cost, and efficiency in assembly/disassembly should be adequately addressed and improvements to ensure cost effectiveness, particularly in the mobile water attraction market, is desired. Rider comfort and/or improvements to rider maneuverability would also be desired. Ideally, a mobile surfing simulator would be inexpensive to construct and/or transport, quick and/or easy to assemble and/or disassemble, and would allow a rider to make contact with the surface of the water attraction, for example, upon falling off of a ride vehicle, with minimal discomfort.

SUMMARY

A water attraction or ride vehicle using inflatable materials is disclosed. In one embodiment, an amusement attraction may include a base having an inflatable portion and defining a cavity therein, the cavity configured to hold a volume of fluid and a riding surface extending over at least a portion of the cavity, at least a portion of the riding surface configured to float upon the volume of fluid in the cavity.

In another embodiment, a surfing attraction may include a base defining a reservoir therein, the reservoir configured to hold a volume of water, a riding surface connected with the base, at least a part of the riding surface configured to float upon the volume of water in the reservoir, a drainage surface connected with the base and configured to drain water into the reservoir, and a water-directing element connected with the riding surface, the riding surface extending over at least a portion of the reservoir and configured to float upon the volume of water in the reservoir.

In still another embodiment, a method for assembling a water attraction having a base defining a cavity therein and a riding surface connected with the base may include inflating the base of the water attraction, and disposing a volume of water in the cavity defined by the base such that a portion of the riding surface floats on at least a portion of the body of water.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale and may be exaggerated to better illustrate the important features of the present invention. In the drawings, like reference numerals designate like parts throughout the different views, wherein:

DETAILED DESCRIPTION

The detailed description of exemplary embodiments herein makes reference to the accompanying drawings and pictures, which show the exemplary embodiments by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
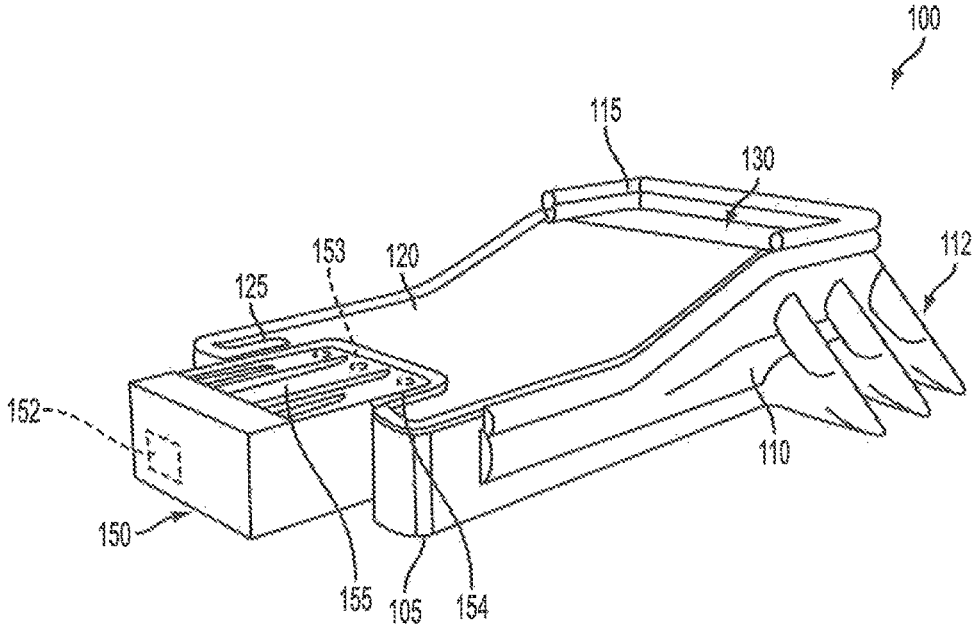
FIG. 1 shows a perspective view of an inflatable surfing apparatus according to an embodiment of the present invention.

Turning first to FIG. 1, an inflatable surfing apparatus 100 is shown from a perspective view. The surfing apparatus 100 may be configured to be a mobile apparatus that is capable of being transported or shipped from one geographic location to another or may be configured to be assembled in one location where it is designed to permanently reside. The surfing apparatus 100 includes a base 105 that defines at least some of the boundaries for a support structure for supporting various components or surfaces of the surfing apparatus 100. The base 105 may be anchored to the ground in one embodiment and/or may remain in place due to the total weight of the inflatable surfing apparatus 100. A riding surface 120 is connected with the base 105 (e.g., at the edges, sides, and/or perimeter of the riding surface 120 in one possible example) and defines a surface that a flow of water may be disposed upon for riders to slide or surf upon, either with a ride vehicle (e.g., a surfboard, boogie board, inflatable ride vehicle, etc.) or without any ride vehicle, as discussed in greater detail herein. Inflatable contact walls 125 are connected with the riding surface 120 and/or the base 105, for example, to help maintain water upon the riding surface 120 until the water reaches a designated area or portion of the surfing apparatus 100 (e.g., drains, channels, troughs, or other means for recirculation of the water). For example, the inflatable contact walls 125 may extend an elevation above the riding surface 120 so that water and/or riders encountering the inflatable contact walls 125 are aided to stay upon the riding surface 120. In an alternative embodiment, if it is desirable for water upon the riding surface 120 to drain from the riding surface 120 laterally, no contact walls 125 may be used.

A first inflatable wall 110 is connected with the base 105 (and/or potentially the contact walls 125) and includes extending or protruding portions 112 for helping maintain balance of the surfing apparatus 100, for example, in an upright orientation. In one embodiment, the contact walls 125 may be a part of the first inflatable wall 110. A second inflatable wall 115 is connected with the first inflatable wall 110 and/or the base 105. The first inflatable wall 110 and the second inflatable wall 115 may be made of different materials (e.g., the first inflatable wall 110 may be made of a stronger or less cushioned material in order to better stabilize the surfing apparatus 100. In an alternative embodiment, the first inflatable wall 110 and the second inflatable wall 115 may be made of the same material or may be the same inflatable wall. Any combination of sectioned walls may be connected to one another and/or to other components to form a structure for supporting a surface that may be ridden by a rider upon a flow of water or a single, non-sectioned structure may be used in different embodiments.

A pump and nozzle assembly 150 (e.g., discussed in greater detail herein) is connected at a front end of the surfing apparatus 100 and is configured to supply a flow (e.g., a sheet flow and/or deep flow) of water or other fluid onto the riding surface 120 in a direction leading away from the front end of the surfing apparatus 100 to a back end of the surfing apparatus 100. A drain portion 130, located at the back end of the surfing apparatus 100, drains the water or other fluid after it travels on the riding surface 120. The pump and nozzle assembly 150 may include one or more pumps 152 that operate to recirculate fluid drained at the drain portion 130 back to nozzles or other fluid-directing elements 153 of the pump and nozzle assembly 150. These nozzles or other fluid-directing elements 153 provide a predetermined amount, volume, and/or flow of fluid onto the riding surface 120. In certain embodiments, the amount, volume, or flow of fluid may be variable.

A cover or planar portion 155 extends over or is connected with the nozzles or other fluid-directing elements 153 of the pump and nozzle assembly 150, for example, to help prevent riders on the riding surface 120 from getting too close and/or colliding or interfering with the nozzles or other fluid directing elements 153. This cover or planar portion 155 made be rigid or semi-rigid, and/or may be made or covered with a padded or soft material to aid in rider comfort in case of a collision therewith. The nozzles or other fluid-directing elements 153 may be disposed or connected adjacent to a bottom surface 154 of the cover or planar portion 155 and near the front side of the riding surface 120 for flowing the flow of water onto the riding surface 120. In an alternative embodiment, the cover or planar portion 155 may be any of a variety of shapes or dimensions as desired and/or the nozzles or other fluid-directing elements 153 may be disposed in any of a variety of numbers or positions in order to flow fluid onto the riding surface 120 as desired for a particular ride application.

Thus, as shown, water (or any other fluid) is configured to flow from the nozzles or other fluid-directing elements 153 at the front end of the surfing apparatus, onto the riding surface 120, which may include a sloped (e.g., upwardly extending planar or curved section) portion that can be ridden or surfed by a rider, and subsequently onto the drain portion 130 where the water is drained and recirculated back to the nozzles or other fluid-directing elements 153 via the one or more pumps 152 for repeated flow onto the riding surface 120. The drain portion 130 drains the water into a cavity or reservoir beneath the riding surface 120, for example, as discussed in greater detail herein. The riding surface 120 and/or the drain portion 130 may be configured to float upon the body of water in the cavity. In certain embodiments, the riding surface 120 and/or drain portion 130 may be attached to the base 105, inflatable walls (110, 115), and/or other components of the surfing apparatus 100 (e.g., a structure holding or connected with the nozzles or other fluid directing elements 153) for stabilizing and/or maintaining the floating riding surface 120 and/or drain portion 130 in a desired position or orientation with one another. In one embodiment, the reservoir cavity may be capable of holding 54,000 liters of fluid.

Any of a variety of portions (e.g., any or all of the components making up the support and riding surfaces) may be inflatable. For example, the base 105, first inflatable wall 110, second inflatable wall 115, riding surface 120, and inflatable contact walls 125 may all be fully inflatable. In an alternative embodiment, any of these components may not be inflatable or may only be partially inflatable (e.g., the riding surface may merely be a fiber, mesh, membrane, etc. material attached, stretched, and/or tensioned as desired, but not comprising an inflatable surface and/or may have certain portions configured to inflate and other portions that do not inflate). Additional or fewer elements or components may be added or removed from the surfing apparatus 100 in an alternative embodiment. Alternative embodiments may utilize modified or different shapes, sizes, or configurations other than that explicitly illustrated in the embodiment of FIG. 1 and other types of fluid or lubrication for sliding a rider on the riding surface 120 may be used (e.g., snow, air, etc.).

In one embodiment, the riding surface 120 and/or other surfaces (e.g., inflatable components) of the surfing apparatus 100 may be formed of a drop-stitch material. Drop stitch material may allow such surfaces to be safe and flexible when accommodating riders or other load-bearing elements, but without tensioning. The surfing apparatus 100 may be modular such that various components can be easily connected or attached to other components (e.g., inflatable slides or other amusement features may be attached to the surfing apparatus 100 to create a larger or more varied amusement or play structure). For example, various padding or pillowed elements may be connected in a modular fashion to form a recovery system for maintenance of a rider within a desired area of the surfing apparatus 100. In this fashion, if a rider falls off their surfboard, boogie board, or other ride vehicle, or otherwise loses control when using the surfing apparatus 100, rider comfort may be increased in the case of a contact with a surface of the surfing apparatus 100. Any of a variety of additional or alternative parts may be used in conjunction with the illustrated components of FIG. 1 and made of inflatable material, partially inflatable material, or a non-inflatable material, for example side closures, transition pads between riding surfaces or other components of the surfing apparatus 100, nozzle flaps, etc.

Figure 2A:
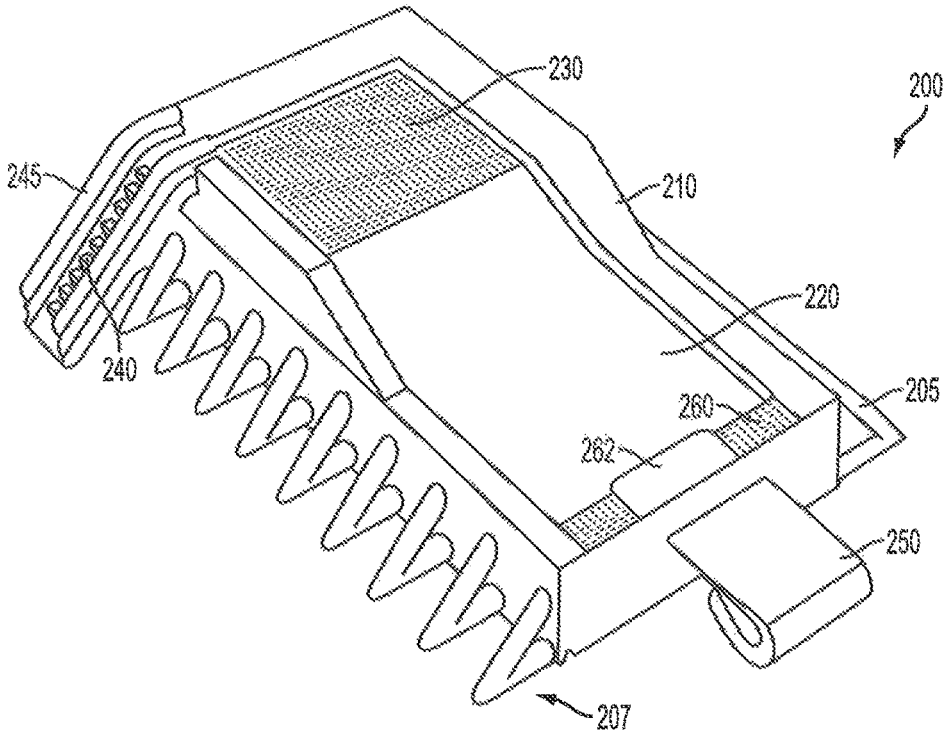
FIG. 2A shows a front-perspective view of an inflatable surfing apparatus according to an embodiment of the present invention.
Figure 2B:
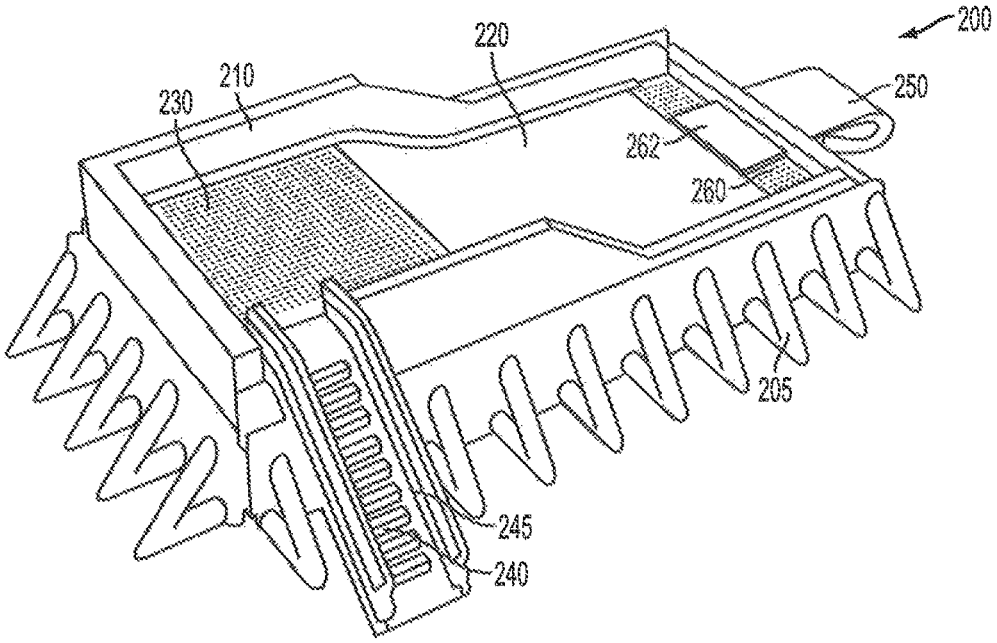
FIG. 2B shows a rear-perspective view of the inflatable surfing apparatus of FIG. 2A according to an embodiment of the present invention.

Turning next to FIG. 2A, a front-perspective view of a surfing apparatus 200 is shown. FIG. 2B shows the surfing apparatus 200 but from a rear-perspective view. The surfing apparatus 200 may include features that are the same as or similar to the surfing apparatus 100, previously discussed. The surfing apparatus 200 includes a base 205, a wall 210, a riding surface 220, drainage surface 230, stairs 240, and a pump/nozzle assembly 250. Similar to the operation previously described for FIG. 1, water flows from the pump/nozzle assembly 250 onto the riding surface 220, and then onto the drainage surface 230 where it is drained (e.g., by falling through a porous surface of the drainage surface 230, for example, as illustrated) to a water reservoir or cavity disposed under the riding surface 220 (e.g., formed by the base 205) so that the water may be recirculated and re-introduced to the riding surface 220 by the pump/nozzle assembly 250. The riding surface 220 may be connected to the base 205 and/or the wall 210 at least partially along its perimeter while configured to float upon the water in the water reservoir.

The stairs 240 may be formed of a rigid or semi-rigid material (e.g., inflatable, partially inflatable, or non-inflatable) and include sidewalls 245 (e.g., inflatable, partially inflatable, or non-inflatable) to help prevent a rider from falling off the side of the stairs 240 when ascending or descending. The base 205 may be inflatable and include extending or protruding portions 207 to aid in supporting the surfing apparatus 200 in the desired, upright orientation when inflated. A platform 262 is disposed adjacent to the pump/nozzle assembly 250 and configured to fit beneath a portion of the pump/nozzle assembly 250 for providing a surface for the portion of the pump/nozzle assembly 250 to mate therewith and/or flow water thereon from the pump/nozzle assembly 250 before the water flows onto the riding surface 220. Drains 260 are positioned on either side of the platform 262 to drain water that is not desirably transmitted onto the riding surface 220 from the pump/nozzle assembly 250 back to the water reservoir.

Figure 2C:
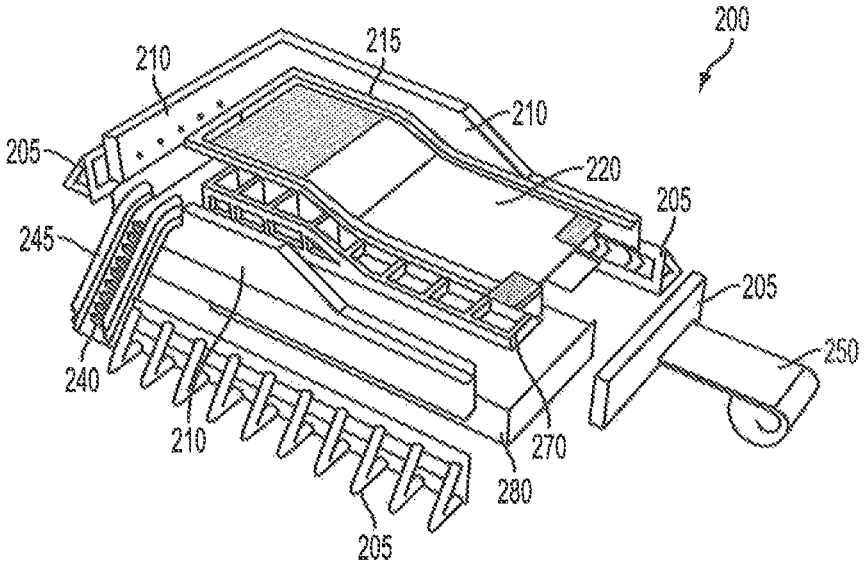
FIG. 2C shows an exploded front-perspective view of the inflatable surfing apparatus of FIG. 2A according to an embodiment of the present invention.
Figure 2D:
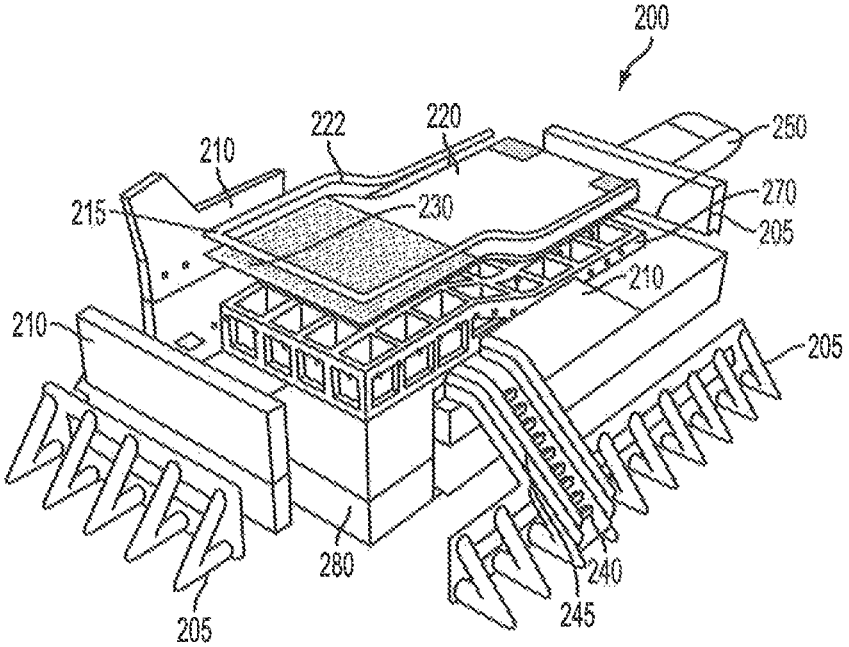
FIG. 2D shows an exploded rear-perspective view of the inflatable surfing apparatus of FIG. 2A according to an embodiment of the present invention.

FIG. 2C shows the surfing apparatus 200 from the front-perspective view, but with certain of the components or parts in an exploded configuration. Similarly, FIG. 2D shows the surfing apparatus 200 from the rear-perspective view, but with certain of the components or parts in an exploded configuration. As illustrated, various separate components make up the surfing apparatus 200 and are configured to connect or assemble together (e.g., by adhesives, bolts, clips, straps, etc.). Certain of these components include the pump/nozzle assembly 250, the base 205, the wall 210, the riding surface 220, the drainage surface 230, the stairs 240, and the sidewalls 245 for the stairs 240. A surrounding contact wall or lip 215 extends around at least a portion of the perimeter of the drain surface 230 and the riding surface 220, for example to help keep riders and/or water within a desired area or portion of the surfing apparatus 200 and/or to close a gap between the riding surface 220 and the wall 210. The base 205 is made up of at least four parts, as shown, that fit together with one another and/or with other components of the surfing apparatus 200 (e.g., the wall 210). Similarly, the wall 210 is made up of at least three parts, as shown, that fit together with one another and/or with other components of the surfing apparatus 200.

In the exploded configurations shown by FIGS. 2C-2D, an inflatable bottom surface 280 and a supporting inflatable structure 270 is viewable. The inflatable bottom surface 280 is configured to rest on the ground and may be part of the base 205 in certain embodiments. The supporting inflatable structure 270 is configured to float upon a body of water between it and the inflatable bottom surface 280. In some embodiments, the supporting inflatable structure may be anchored to the bottom surface 280 and/or other components of the surfing apparatus 200. Both the inflatable bottom surface 280 and the supporting inflatable structure 270 are located beneath the riding surface 220 and/or drainage surface 230 and act to support and/or stabilize the surfing apparatus in a desired, upright orientation such that the riding surface 220 can be ridden by riders. An area between the bottom surface 280 and the supporting inflatable structure 270 forms the water reservoir or water tank for the recirculation of water during operation. In one embodiment, a layer of material 272 (e.g., drop stitch material) may be disposed between the supporting inflatable structure 270 and the riding surface 220. The inflatable structure 270 and/or layer of material 272 may extend so as to fully cover the bottom surface 280 or reservoir formed as part of the surfing apparatus or may only cover a portion of the bottom surface 280 or reservoir.

Figure 2E:
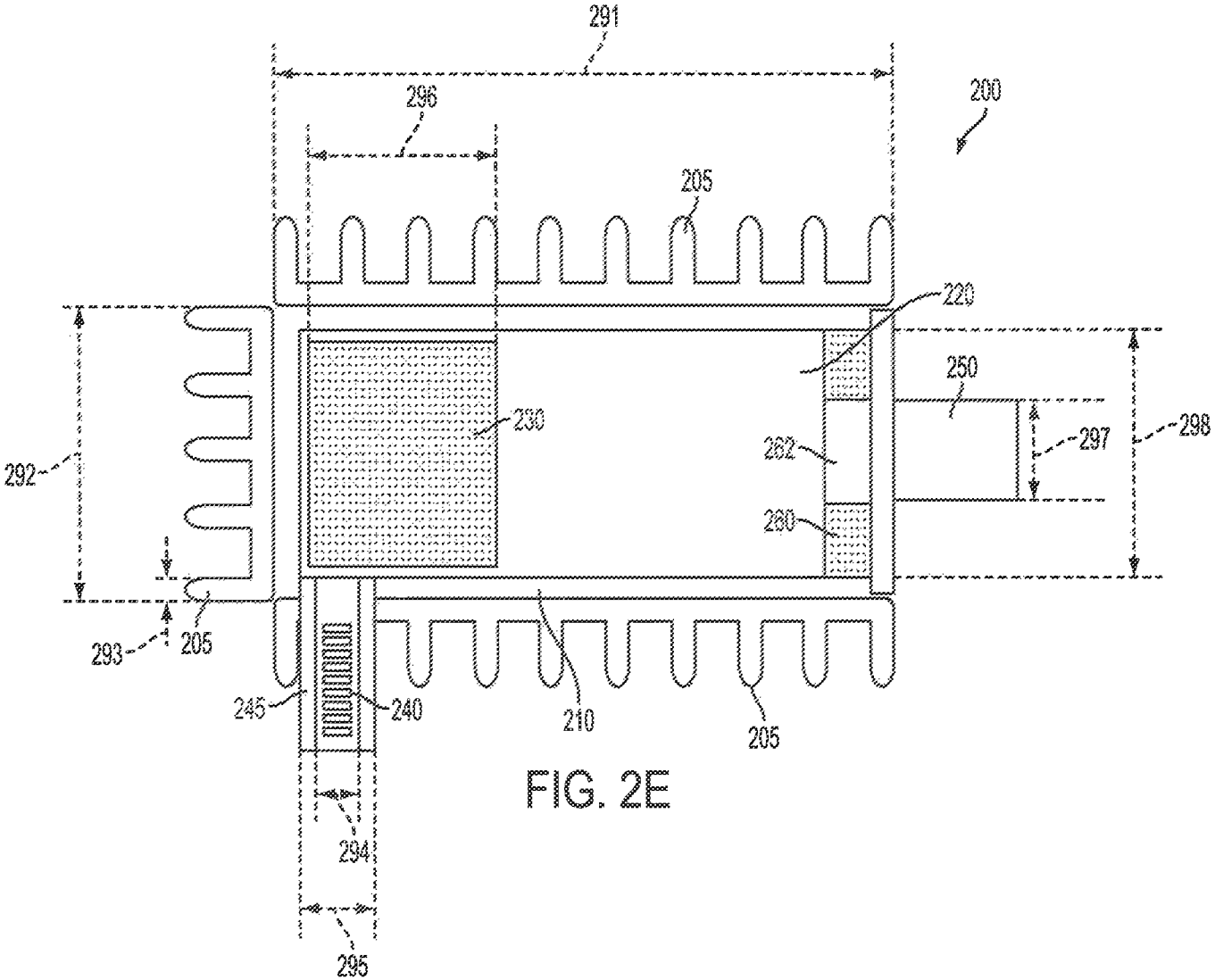
FIG. 2E shows an exploded top view of the inflatable surfing apparatus of FIG. 2A according to an embodiment of the present invention.

FIG. 2E shows an exploded top view of the inflatable surfing apparatus 200 of FIG. 2A. The base 205 may be made up of separate components such that, when assembled, the surfing apparatus has an overall rectangular configuration being approximately 1256.7 cm in length 291 and 595 cm in width 292. Each of the extension elements 207 of the base 205 may be 48 cm in width 293. The stairs 240 may be 86.3 cm in width 294 and 147.3 cm in total width 295 when combined with the two sidewalls 245. The drainage surface 230 may extend for 400 cm in length 296 from a rear end of the ride until the beginning of the riding surface 220. As shown, the pump/nozzle assembly 250 may be 207 cm in width 297 while the width of the riding surface 220 may be 456 cm wide 298. In an alternative embodiment, any of a variety of desired dimensions, configurations, or shapes may be used for the design of the surfing apparatus 200.

Figure 2F:
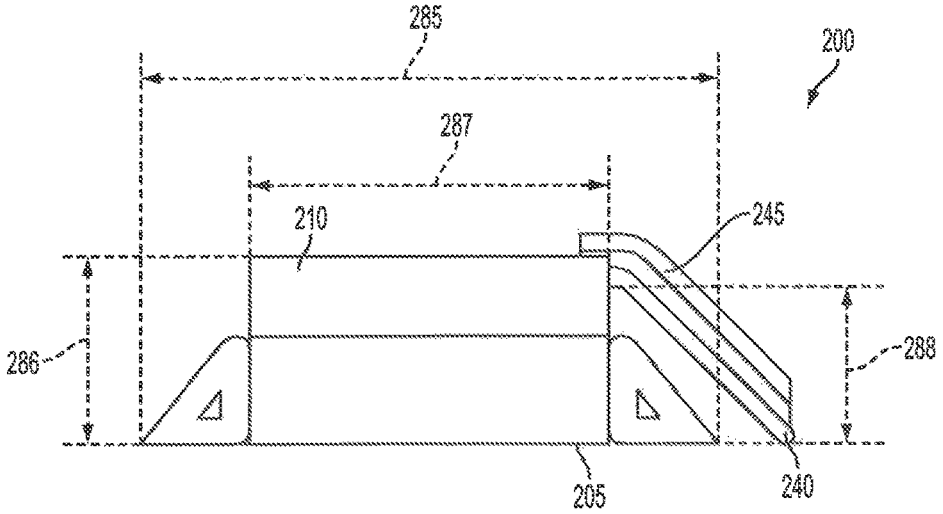
FIG. 2F shows a side view of a rear end of the inflatable surfing apparatus of FIG. 2A according to an embodiment of the present invention.

FIG. 2F shows a side view of a rear end of the surfing apparatus 200 of FIG. 2A. In one embodiment, the complete width 285 of the surfing apparatus 200 (e.g., made up of various connectible base 205 elements) may be approximately 957.4 cm. A height 286 from the ground to the top of the wall 210 may be 322 cm. The width 287 of the rear portion of the wall 210 may be 595 cm. A height 288 from the ground to the top of the linearly-inclined portion of the stairs 240 may be 266 cm. In an alternative embodiment, any of a variety of desired dimensions, configurations, or shapes may be used for the design of the surfing apparatus 200.

Figure 3A:
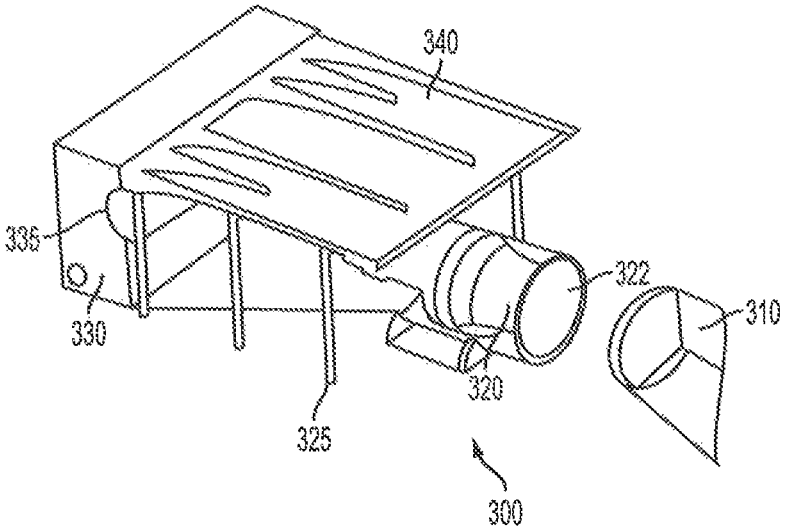
FIG. 3A shows a perspective view of a nozzle and pump assembly for use with an inflatable surfing apparatus according to an embodiment of the present invention.
Figure 3B:
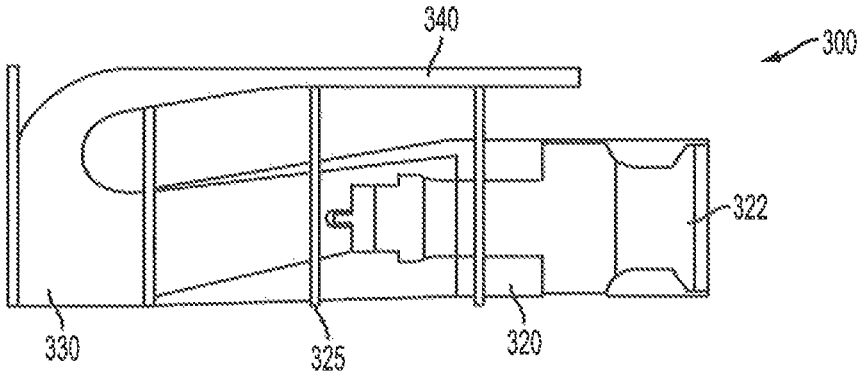
FIG. 3B shows a side view of the nozzle and pump assembly of FIG. 3A according to an embodiment of the present invention.

FIGS. 3A and 3B show a perspective view and a side view, respectively, of a pump and nozzle assembly 300 for use with an inflatable surfing apparatus. The surfing apparatus and/or the pump and nozzle assembly 300 may include features or aspects that are the same as or similar to those previously discussed. The pump and nozzle assembly 300 includes a connector 322 disposed within a container or tube 320 for the purpose of receiving and flowing a fluid (e.g., water) within the container or tube 320 for distribution onto a riding surface of the surfing apparatus. The connector 322 is configured to connect with a suction inlet 310. A pump (e.g., located in the container or tube 320) is configured to pump the fluid (e.g., water from a water reservoir that is disposed under the riding surface of the surfing apparatus) through the connector 322 and the container or tube 320. In an alternative embodiment, part or all of the pump may be disposed in alternative locations for pumping or otherwise pressurizing fluid so that it flows through the container or tube 320.

A back portion 330 of the pump and nozzle assembly 300 includes a curved segment 335 wherein the fluid flows within from the connector 322, through the container or tube 320, and to a planar portion 340 of the nozzle assembly. One or more nozzles or other fluid-directing elements may be disposed within or connected with the planar portion 340, for example as previously discussed, for directing the fluid onto an adjacent riding surface at a desired velocity, flow rate, or orientation, etc. The planar portion 340 may be configured to connect or otherwise be disposed adjacent to the riding surface of the surfing apparatus (e.g. centered along a width of the riding surface). The pump and nozzle assembly 300 may be configured to interface or connect with an inflatable attraction from outside of the inflatable attraction, for example, in a modular nature.

Figure 4A:
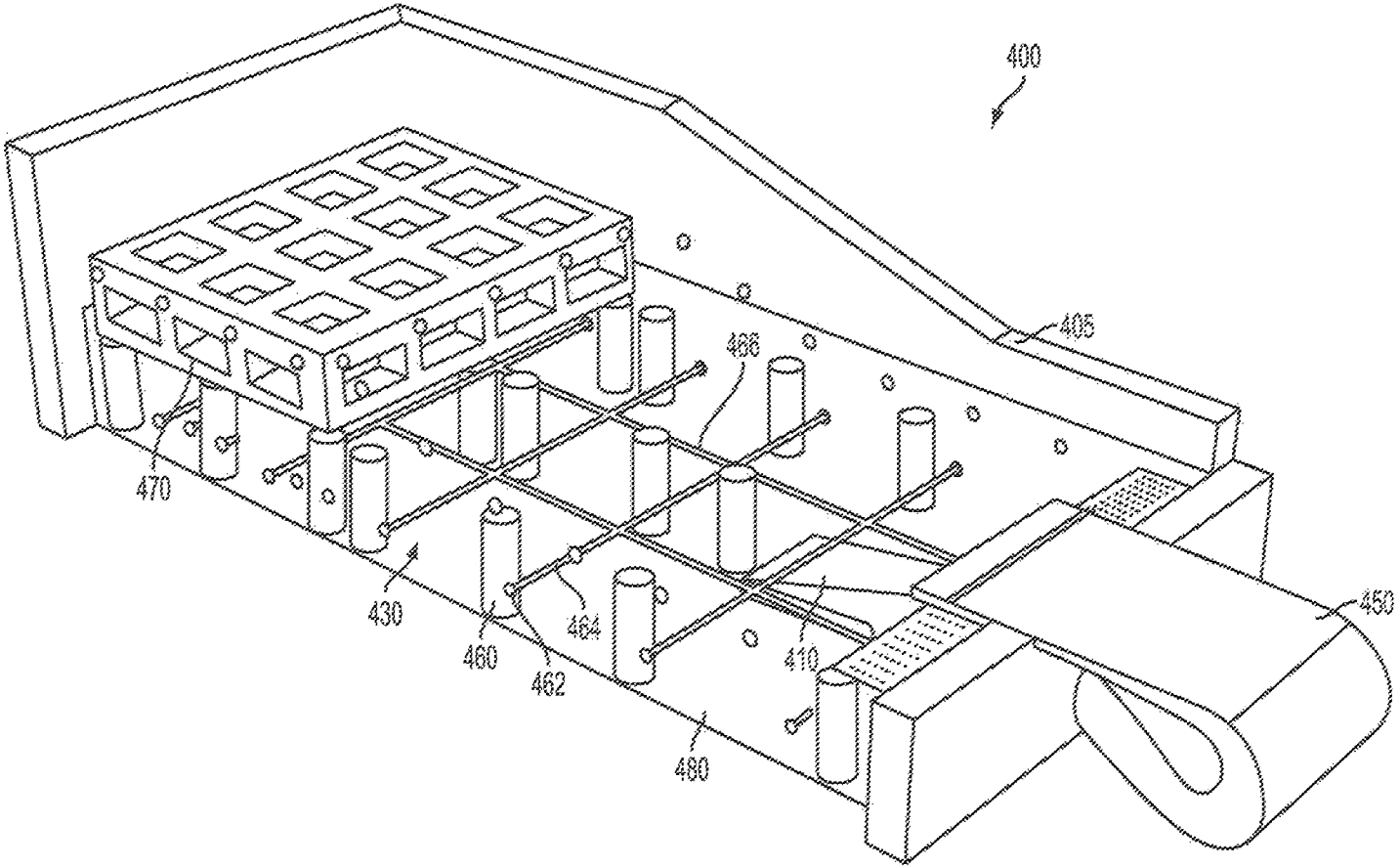
FIG. 4A shows a front-perspective view of an inflatable surfing apparatus illustrated from a cut-away view for showing a support structure according to an embodiment of the present invention.
Figure 4B:
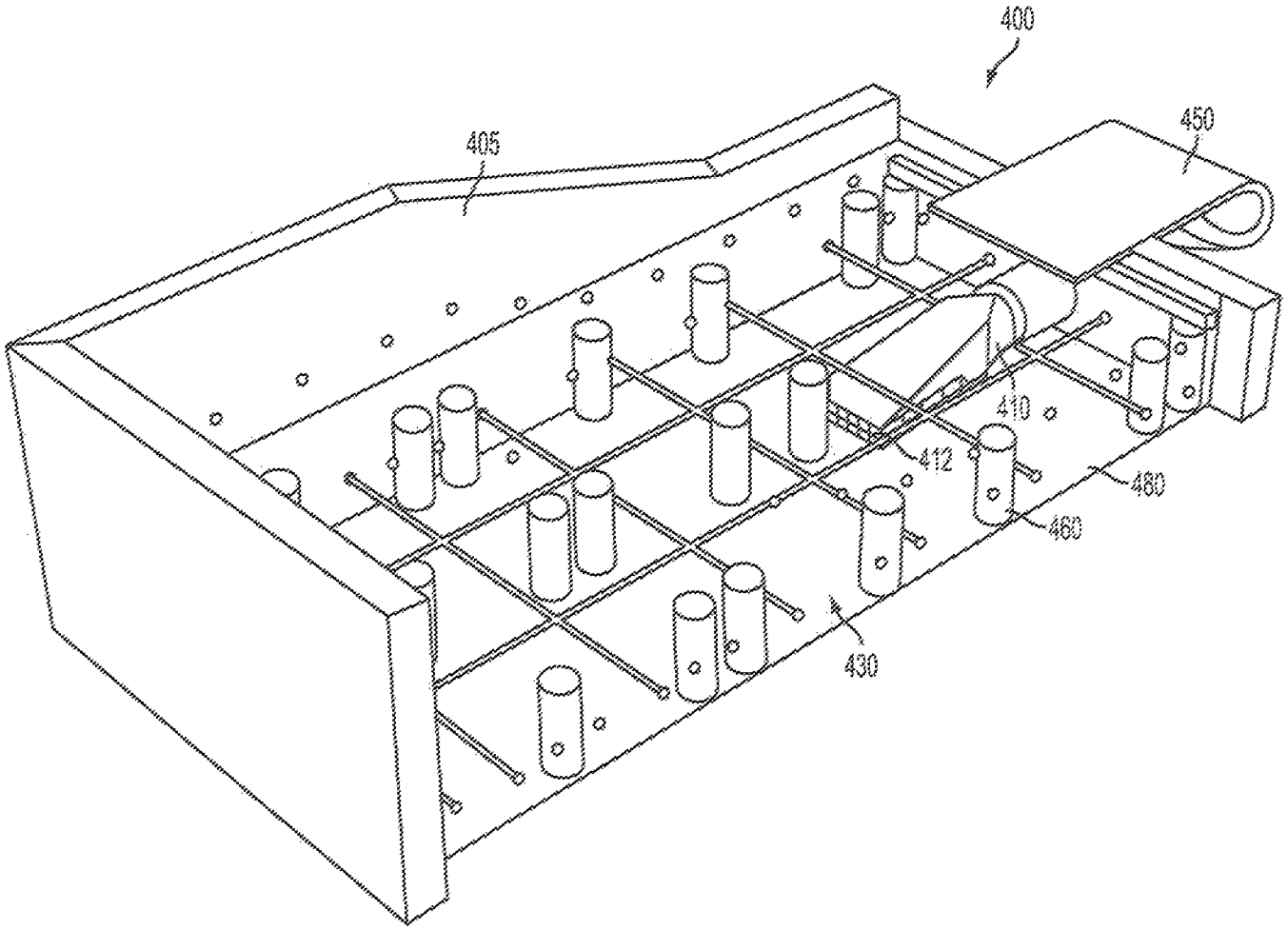
FIG. 4B shows a rear-perspective view of the surfing apparatus of FIG. 4A according to an embodiment of the present invention.

Turning next to FIG. 4A, a front-perspective view of a surfing apparatus 400 illustrated with a cut-away perspective for showing a support structure therein is shown. Similarly, FIG. 4B shows a rear-perspective view of the surfing apparatus 400 illustrated with a cut-away perspective. The surfing apparatus 400 and/or the support structure may include features or aspects that are the same as or similar to those previously discussed. As shown, a base 405 defines at least part of an outer wall or boundary for the surfing apparatus 400 and a support structure having various components is disposed therein, discussed in greater detail below. A floor 480 makes up a bottom surface of the surfing apparatus 400 and may be made of any of a variety of inflatable or non-inflatable materials. A plurality of beams or columns 460 are located on the floor 480 (e.g., secured or otherwise connected with the floor 480) and extend upward towards an upper surface (e.g., a riding surface) of the surfing apparatus 400. The plurality of beams 460 may provide support for the upper surface such that a rider can ride upon a flow of water on the upper surface.

An inflatable structure 470 is disposed on top of certain of the plurality of beams 460 and provides a stable structure for supporting riders as they enter or exit the surfing apparatus 400 while also providing a porous structure for water to drain through after the water flows across the upper surface of the surfing apparatus 400. Thus, after draining through the inflatable structure 470, the water arrives in a water reservoir 430 or cavity formed via the base 405, the floor 480, and underneath the inflatable structure 470 and upper surface (e.g., riding surface) of the surfing apparatus 400. When water is within the water reservoir 430 it may be pumped through a suction inlet 410 and directed via nozzles in a pump and nozzle assembly 450 back to a riding or upper surface of the surfing apparatus 400. As shown in FIG. 4B, a grating 412 may be located at an opening of the suction inlet 410 in order to help prevent foreign objects in the water from getting sucked into the suction inlet and/or pump and nozzle assembly 450.

A plurality of attachment mechanisms 462 are disposed in the base 405, inflatable structure 470, and/or beams 460 that are configured to connect with a plurality of stabilizing elements (464, 466) that extend between attachment mechanisms 462 on opposite sides of the surfing apparatus 400. For example, the attachment mechanisms 462 may be openings in the base 405 and the stabilizing elements (464, 466) may be rigid rods that are received by the openings. Certain of the stabilizing elements (464, 466) may be configured to engage with one or more beams 460 or other components of the surfing apparatus 400 (e.g., the inflatable structure 470) in order to stabilize multiple components of the surfing apparatus 400 together. Certain of the stabilizing elements may cross one another at a perpendicular orientation, or may be positioned as parallel elements, as illustrated. In an alternative embodiment, any number of stabilizing elements (464, 466) and/or attachment mechanisms 462 may be used, in any of a variety of positions or orientations.

Figure 4C:
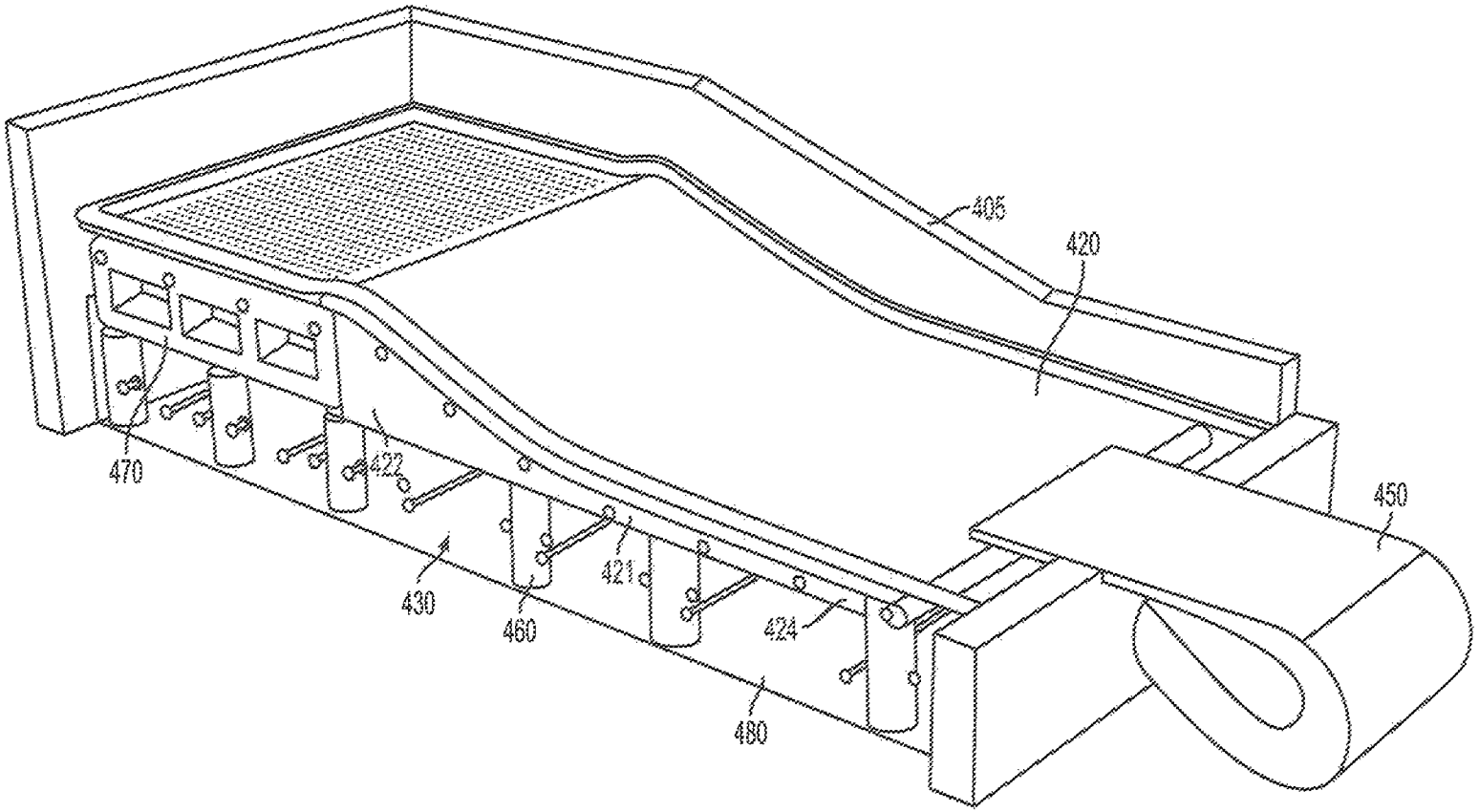
FIG. 4C shows a front-perspective view of the surfing apparatus of FIG. 4A with a riding surface connected on top of the support structure according to an embodiment of the present invention.

FIG. 4C shows a front-perspective view of the surfing apparatus 400, but is illustrated with the upper surface 420 (e.g., a riding surface) connected on top of certain of the plurality of beams or columns 460. The upper surface 420 may be a low-friction material that is connected to an inflatable pad 421 or other surface, the inflatable pad 421 making contact with certain of the plurality of beams 460. As shown, the inflatable pad 421 may vary in thickness as it extends from a rear of the surfing apparatus 400 to a front of the surfing apparatus 400. For example, a rear portion 422 of the inflatable pad 421 may be thicker than a front portion 424 of the inflatable pad 421. In this manner, riders may carve or ride on a surf board, boogie board, etc. upon a flow of water traveling from the front portion 424 towards the rear portion 422 of the upwardly sloping upper surface 420. The inflatable pad 421 may be shaped with ridges or other dimensions such that it imparts a force upon the upper surface 420, for example, to cause a desired waveform when water is flowing over the upper surface 420. In certain embodiments, the inflatable pad 421 may have separate inflatable compartments such that only desired portions of the inflatable pad 421 (e.g., certain of the inflatable compartments) are inflated. In this fashion, varying shapes can be imparted upon the upper surface 420 by selectively inflating desired portions of the inflatable pad 421. Such functionality allows a variety of potential waveforms on the upper surface 420 merely by inflating or deflating portions of the inflatable pad 421.

In an alternative embodiment, the inflatable pad 421 may not be inflatable and/or may be disposed with other thicknesses (e.g., a constant thickness) or configurations. For example, to generate alternative water flow paths, the inflatable pad 421 and/or upper surface 420 may be configured or oriented to have ridges, valleys, or other shapes in other locations from those explicitly illustrated to create desired waveforms or water-flow characteristics. In still another embodiment, the inflatable pad 421 and/or upper surface 420 may be configured to be modular and/or easily replaceable such that a ride operator can quickly and/or easily alter the surfing apparatus 400 to have different surfing waveform characteristics.

Figure 4D:
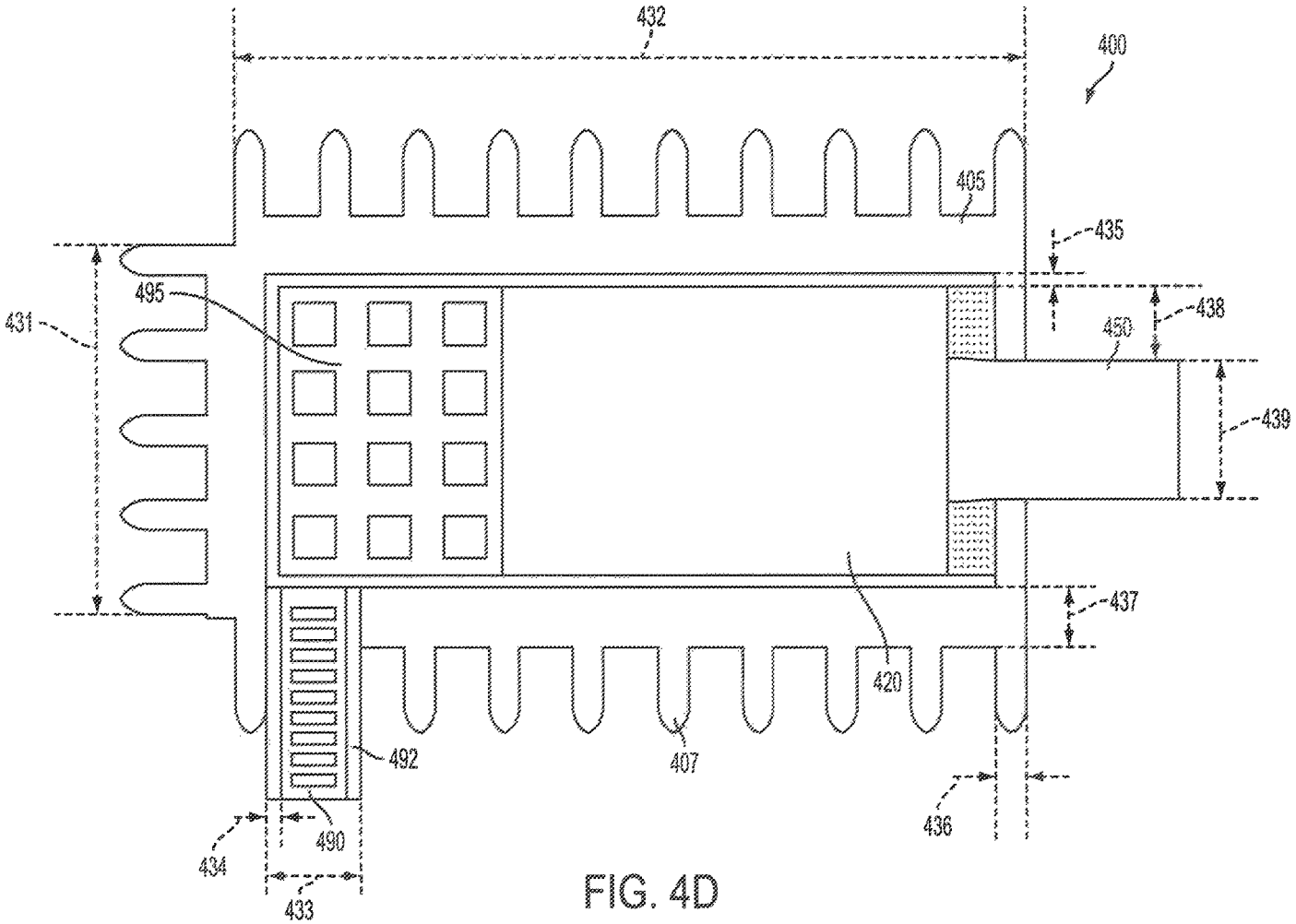
FIG. 4D shows a top view of the surfing apparatus of FIG. 4A according to an embodiment of the present invention.

FIG. 4D shows a top view of the surfing apparatus 400 illustrated with the upper surface 420. For example, a rearward part of the base 405 may be 592.1 cm in width 431 while a sideward part of the base 405 may be 1255.1 cm in total width 432. The base 405 is also shown as having a plurality of extending or protruding arms 407 to aid in the stability of the surfing apparatus 400. A staircase 490 of the surfing apparatus 400 may have a total width 433 of 153 cm, a plurality of sidewalls 492 of the staircase 490 each being 30.5 cm wide 434. A drainage surface 495 is also shown adjacent to the upper surface 420, the same as or similar to previous discussions, for draining water to the water reservoir 430 (see FIGS. 4A-4B) after the water flows off of the upper surface 420. A sidewall width 435 may be 22 cm, a protrusion width 436 may be 46 cm, a base width 437 may be 94 cm, a drain width 438 may be 140 cm, and a pump and nozzle assembly width 439 may be 220 cm. In an alternative embodiment, any of a variety of dimensions, widths, lengths, etc. may be used for various component parts.

Figure 5A:
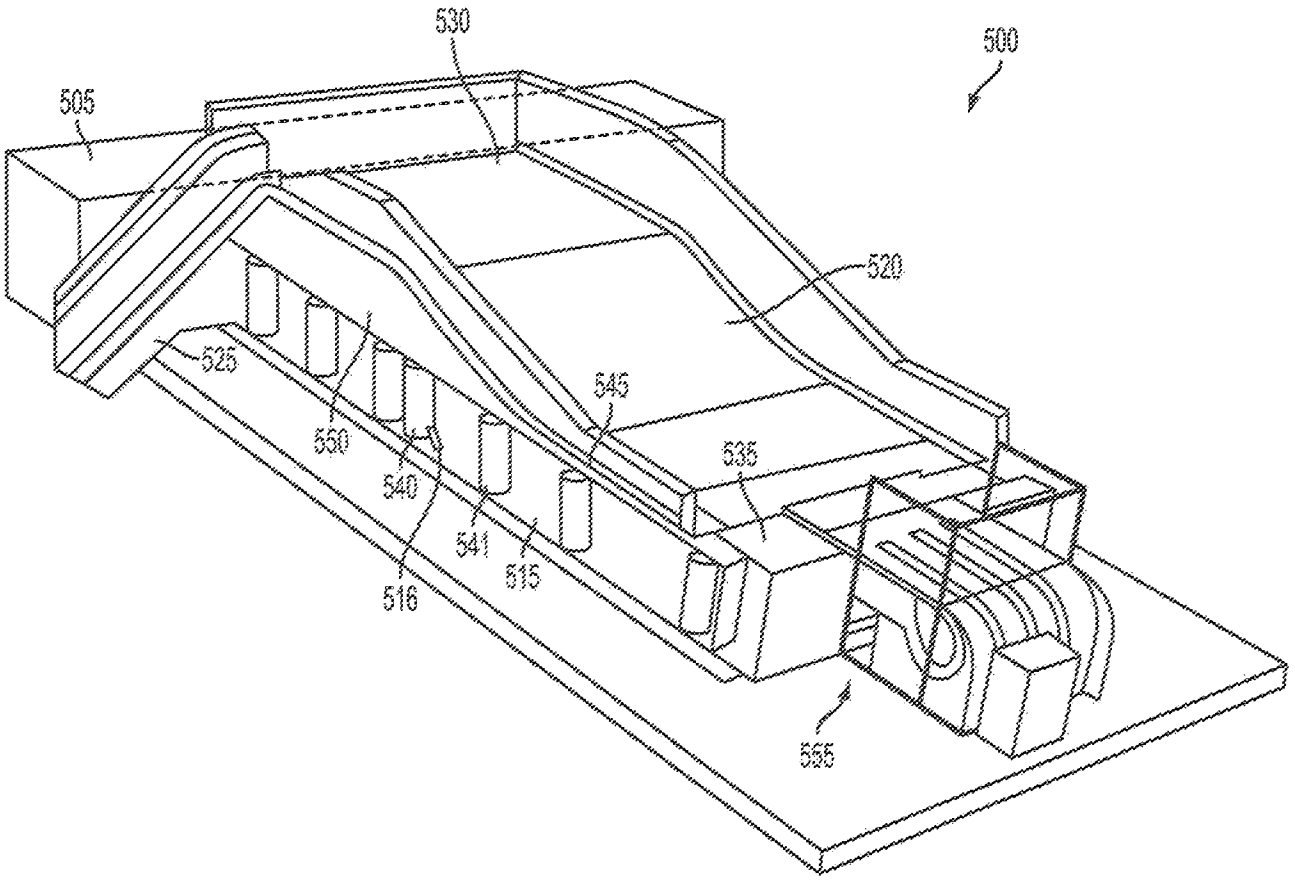
FIG. 5A shows a perspective view of an inflatable surfing apparatus according to an embodiment of the present invention.

Turning next to FIG. 5A, a perspective view of an inflatable surfing apparatus 500 is shown. The surfing apparatus 500 may include features or aspects that are the same as or similar to those previously discussed. The surfing apparatus 500 is configured to be a mobile or portable ride attraction and fits, when disassembled, within one or more containers 505 for shipment. The container 505 serves a second purpose for housing filtration units, piping or plumbing, electronic controls, etc. for the surfing apparatus 500 when the surfing apparatus 500 is assembled and operational. Thus, as shown, the container 505 may house such components and may be connected at a rear end of the surfing apparatus 500 during use and connect with other components of the surfing apparatus 500 through a backwall of the surfing apparatus 500.

The surfing apparatus 500 includes an inflatable structure 515 making up one or more walls or exterior surfaces. In an alternative embodiment, protruding elements or arms (not shown) may extend from the inflatable structure 515 on any side of the inflatable structure 515 in order to provide increased stability, balance, or support for the surfing apparatus 500 during use. A riding surface 520 connects with the inflatable structure 515 and provides a surface upon which a rider may surf, skim, or otherwise ride, either with a ride vehicle, such as a surfboard, or without a ride vehicle. In one embodiment, the riding surface may be a sheet or other fabric or material that is tensioned across or otherwise attaches to the inflatable structure 515.

Two layers of material are located beneath the riding surface 520. A first layer 545 may be a thin layer (e.g., 8 cm thick) of material. In one embodiment, the first layer 545 may be a drop stitch material that inflates flat. A second layer 550 may be a layer with a varying thickness (e.g., thicker near a rear portion of the surfing apparatus 500 and thinner near a front portion of the surfing apparatus 500 in order to provide an inclined shape for the riding surface 520. In one embodiment, the second layer 550 may be a non-drop stitch inflatable material. A dewatering area 530 is located adjacent to the riding surface 520 for draining water that flows across the riding surface 520 from a pump and/or nozzle assembly 555 to a water reservoir located beneath the dewatering area 530 and/or riding surface 520. In one embodiment, the riding surface 520, the first layer 545, and/or the second layer 550 may be configured to float upon a body of water that is contained within the reservoir located beneath the dewatering area 530 and/or riding surface 520.

A plurality of cylinders or columns 540 are located underneath the second layer 550 and operate to support the second layer 550, the first layer 545, the riding surface 520, and/or the dewatering area 530. One or more of the plurality of cylinders 540 may be configured to be anchored to the inflatable structure 515 via straps 516. In one embodiment, the straps 516 may be heat-welded vinyl that secures to the inflatable structure 515 and/or the cylinder 540. In one embodiment, the plurality of cylinders 540 may be PVC pipes. The plurality of cylinders 540 may be configured to be filled with water (e.g., water that is circulated through the water reservoir). For example, each of the plurality of cylinders 540 may be covered such that water is contained therein or each of the plurality of cylinders 540 may be uncovered and/or have one or more holes disposed therein so that water in the water reservoir is capable of flowing into and/or out of each of the plurality of cylinders 540.

A staircase 525 may be formed as part of the inflatable structure 515 or connected to the inflatable structure 515 for allowing riders to enter and/or exit the riding surface 520. In an alternative embodiment, the staircase 525 and/or additional staircases or other entry or exit means (e.g., slides, ladders, etc.) may be disposed at any desired location to permit entrance or exit by riders (e.g., near the pump and/or nozzle assembly 555).

Figure 5B:
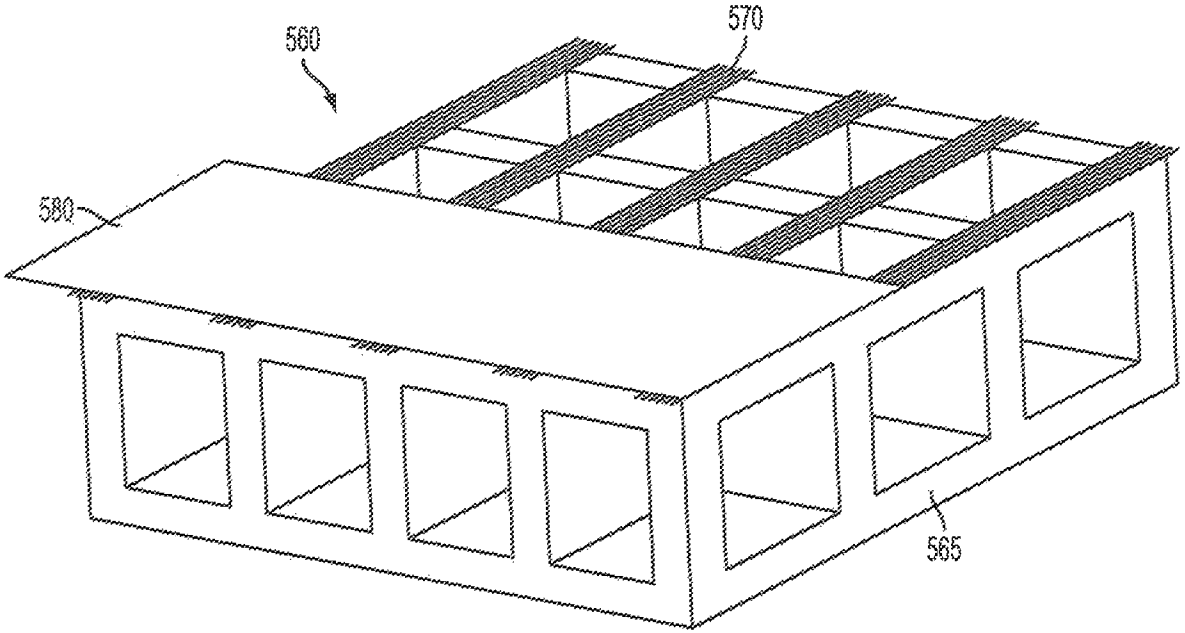
FIG. 5B shows a perspective view of a dewatering area for use with an inflatable surfing apparatus according to an embodiment of the present invention.

FIG. 5B shows a perspective view of a dewatering area 560 for use with an inflatable surfing apparatus (e.g., the surfing apparatus 500 of FIG. 5A). The dewatering area 560 may include features or aspects that are the same as or similar to those previously discussed. The dewatering area 560 includes an inflatable portion 565 (e.g., the second layer 550 of FIG. 5A) and a plurality of gratings 570 that permit water or other fluid to drain through gratings 570 and through or past the inflatable portion 565 to a water reservoir. A pad or mat 580 is disposed on top of at least a portion of the gratings 570 and/or inflatable portion 565. The pad or mat 580 may or may not be inflatable, but may be soft to provide a more comfortable surface for riders to impact, for example, upon falling or being swept by a flow of water onto the dewatering area 560. The pad or mat 580 may also be configured to permit water or other fluid to drain therethrough. In an alternative embodiment, the pad or mat 580 may also be disposed at other or additional locations on a surfing apparatus (e.g., adjacent to the pump and/or nozzle assembly 555 of FIG. 5A).

Figure 5C:
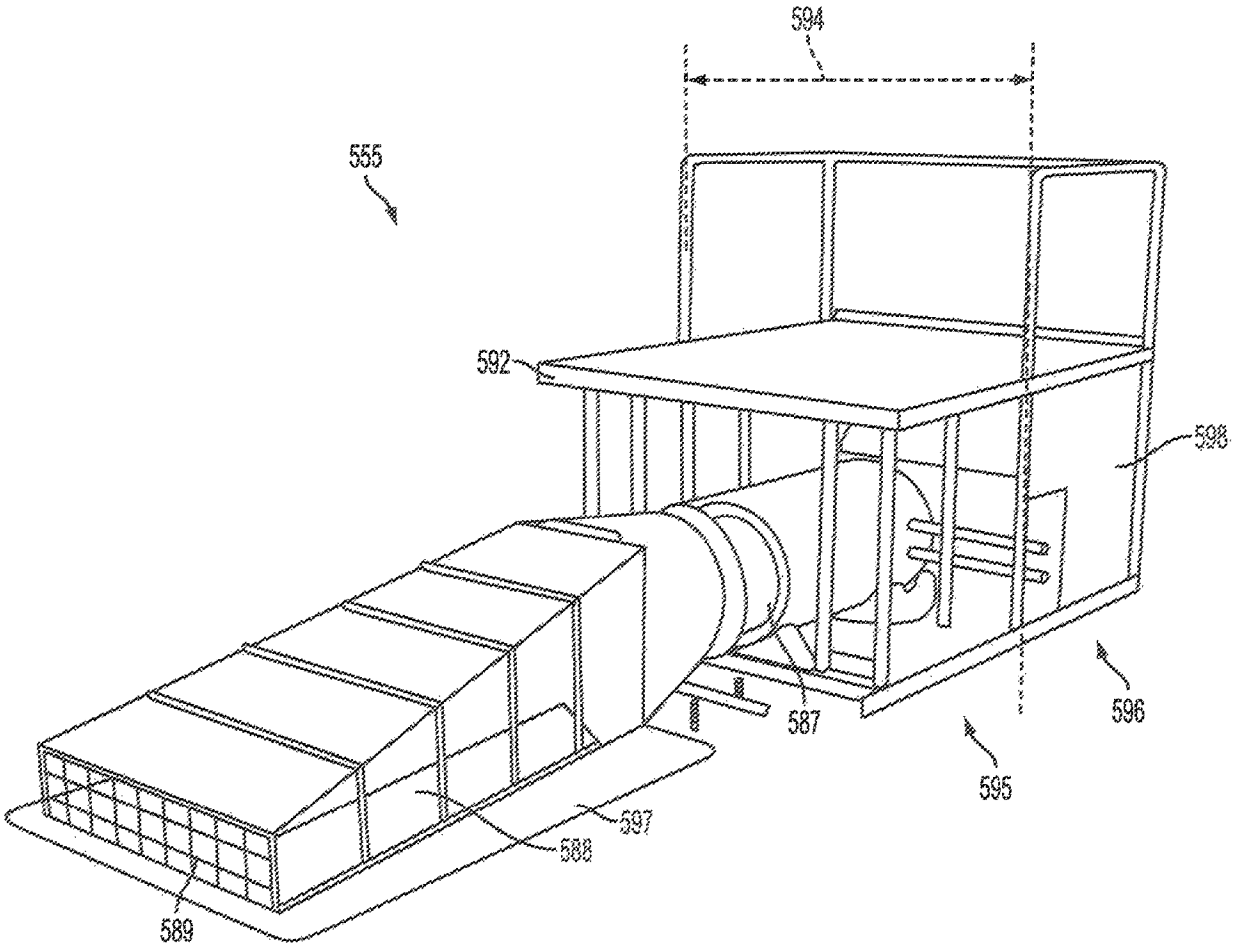
FIG. 5C shows a perspective view of a pump and nozzle assembly for use with an inflatable surfing apparatus according to an embodiment of the present invention.

FIG. 5C shows a perspective view of the pump and nozzle assembly 555 for use with an inflatable surfing apparatus according to an embodiment of the present invention. The pump and nozzle assembly 555 and/or the inflatable surfing apparatus may include features that are the same as or similar to those previously discussed. The pump and nozzle assembly 555 includes a suction inlet 588 that incorporates a mesh or grating 589 for the suction of water therethrough (e.g., water from a water reservoir of the inflatable surfing apparatus 500). The mesh or grating 589 may be configured to prohibit foreign objects beyond a predetermined size from being sucked or otherwise enter into the pump and nozzle assembly 555. In one embodiment, the suction inlet 588 may be made of a steel material. A mounting plate 597 (e.g., made of fiberglass) may be used for securing the suction inlet 588 and/or other components of the pump and nozzle assembly 585 to the ground, floor, or bottom surface of the surfing apparatus 500.

Connected with the suction inlet 588 is a pump tube 587 that houses or otherwise interfaces with pumping equipment for the movement of water from the reservoir, into the suction inlet 588, and through the pump tube 587. The pump tube 587 of the pump and nozzle assembly 555 may be configured to be partially submerged (e.g., a portion of the pump tube 587 at an end closest to the suction inlet 588 may be located within a water reservoir of the inflatable surfing apparatus 500 and thus submerged in water while a portion of the pump tube 587 at an end furthest from the suction inlet 588 may be located outside of the water reservoir of the inflatable surfing apparatus 500 and thus not submerged in water.

As illustrated, a wall of the inflatable surfing apparatus 500 may be configured to extend along a plane 594 and define an opening therein for accommodating the pump tube 587, thus disposing a portion of the pump and nozzle assembly 555 within 595 the inflatable surfing apparatus 500 and a portion of the pump and nozzle assembly 555 outside 596 of the inflatable surfing apparatus 500. A sleeve or other gasket may extend around all or a portion of the pump tube 587 within this plane 594 in order to provide a watertight seal such that water cannot leak from the area within 595 the inflatable surfing apparatus to outside 596 of the inflatable surfing apparatus through the opening defined by the wall. In an alternative embodiment, the pump tube 587 may be fully submerged or fully not submerged.

One or more nozzles 592 are connected to the pump tube 587 via piping or plumbing 598 such that water pumped through the suction inlet 589 is delivered to the one or more nozzles 592 and may then be delivered to a riding surface of the inflatable surfing apparatus. In one embodiment, the one or more nozzles 592 may be connected in a side-by-side configuration (e.g., extending 2.3 meters in length or less) so as to conveniently fit within a standard shipping container. Cables for providing electrical signals to operate one or more of the components of the pump and nozzle assembly 555 may be connected to motors, generators, computer systems, etc. in order to control the one or more components of the pump and nozzle assembly 555 for providing a desired rate of water flow or quantity of water to a riding surface of the inflatable surfing apparatus. In one embodiment, the cables are not submerged (e.g., are positioned outside 596 of the inflatable surfing apparatus).

Although the embodiments shown and described above feature water attractions having particular configurations or shapes, an inflatable material or inflatable components may be implemented on any of a variety of water or other attractions. In one example, entry and/or exit locations for a rider to enter and/or exit from a water ride may differ from those explicitly shown in the embodiments illustrated (e.g., a staircase may be located at an alternative position or no staircase may be used). In another example, a water attraction, such as a standing wave surfing ride, may have its entire main structure or riding surface as an inflatable structure or made from an inflatable material. Alternatively, a water attraction, such as a standing wave surfing ride, may only be constructed only partially with inflatable structures and other components of the ride being non-inflatable, for example, to aid in stability or to increase the load-bearing characteristics of the ride. Although the various embodiments illustrated and described incorporate a variety of features, components, and/or operation, not all such features, components, and/or operation may be utilized within a desired embodiment. Instead, certain, but not all, of the features, components, and/or operation may be chosen for a particular embodiment.

The inflatable portion may be positioned at any desired location along the water attraction, for example, to provide a less rigid surface for more comfortably supporting riding thereon and/or to absorb an impact of the rider or a ride vehicle. For example, the inflatable structure may be completely above ground, completely below ground, or partially above and below ground. In some embodiments, a water reservoir of the water attraction may be made of the inflatable material. A water attraction using an inflatable portion or portions may be modular in nature such that it may be more easily manufactured, transportable, and/or constructed on a given location. For example, a water attraction using an inflatable portion or portions may be designed to be portable such that it is intended to be used at a given geographic location for a short period and then deflated and/or deconstructed and shipped to a new location.

The previous description of the disclosed examples is provided to enable any person of ordinary skill in the art to make or use the disclosed methods and apparatus. Accordingly, the terminology employed throughout should be read in a non-limiting manner. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An amusement attraction comprising:

a base having an inflatable portion and defining a cavity therein, the cavity configured to hold a volume of fluid;

a riding surface connected with the base and extending over at least a portion of the cavity for floating upon the volume of fluid in the cavity;

wherein the riding surface is inflatable; and an inflatable pad;

wherein the inflatable pad is:

(i) disposed between the volume of fluid and the riding surface, (ii) separate from the riding surface, and (iii) configured to change a shape of the riding surface by selectively inflating portions of the inflatable pad, and wherein at least a part of the inflatable pad is configured to float upon the volume of fluid.

2. The amusement attraction of claim 1 wherein the fluid is water.

3. The amusement attraction of claim 1 further comprising at least one beam disposed within the cavity of the base wherein the at least one beam is connected with the riding surface for stabilizing the riding surface.

4. The amusement attraction of claim 1 further comprising at least one beam disposed within the cavity of the base wherein the at least one beam is connected with the riding surface for stabilizing the riding surface.

5. The amusement attraction of claim 4 further comprising wherein the inflatable pad is connected between the riding surface and the at least one beam.

6. The amusement attraction of claim 1 further comprising:

a first attachment mechanism connected with the base;

a second attachment mechanism connected with the base; and a first stabilizing element disposed at least partially within the cavity and connected between the first attachment mechanism and the second attachment mechanism.

7. The amusement attraction of claim 6 wherein the first stabilizing element is a rigid material.

8. The amusement attraction of claim 6 further comprising:

a third attachment mechanism connected with the base;

a fourth attachment mechanism connected with the base; and a second stabilizing element disposed at least partially within the cavity and connected between the third attachment mechanism and the fourth attachment mechanism, the second stabilizing element perpendicular to the first stabilizing element.

9. A surfing attraction comprising:

a base defining a reservoir therein, the reservoir configured to hold a volume of water;

a riding surface extending over at least a portion of the reservoir so that at least a portion of the riding surface floats upon the volume of water in the reservoir;

wherein the riding surface is inflatable;

an inflatable pad;

wherein the inflatable pad is:

(i) disposed between the reservoir and the riding surface, (ii) separate from the riding surface, and (iii) configured to change a shape of the riding surface by selectively inflating portions of the inflatable pad, wherein at least a part of the inflatable pad configured to float upon the volume of water in the reservoir;

a drainage surface connected with the base and configured to drain water into the reservoir; and a water-directing element for emitting a flow of water onto the riding surface.

10. The surfing attraction of claim 9 wherein the inflatable pad has a greater thickness at a first end of the inflatable pad than at a second end of the inflatable pad.

11. The surfing attraction of claim 9 wherein the inflatable pad is configured to apply a force upon the riding surface to form a shape of riding surface.

12. The surfing attraction of claim 9 further comprising a column disposed within the reservoir and configured to support the inflatable pad.

13. The surfing attraction of claim 9 wherein the water-directing element is a nozzle.

14. The surfing attraction of claim 9 further comprising a pump tube connected with the water-directing element and configured to flow water from the reservoir to the water-directing element, the pump tube positioned at least partially within the reservoir.

15. The surfing attraction of claim 9 further comprising an auxiliary drainage surface positioned adjacent to the water-directing element, the auxiliary drainage surface configured to drain water into the reservoir.

16. A water attraction comprising:

an inflatable base defining a cavity therein for holding a volume of water;

a riding surface connected with the base for floating upon at least a portion of the volume of water in the cavity;

wherein the riding surface is inflatable;

an inflatable pad;

wherein the inflatable pad is:

(i) disposed between the volume of fluid and the riding surface, (ii) separate from the riding surface, and (iii) configured to change a shape of the riding surface by selectively inflating portions of the inflatable pad, wherein at least a part of the inflatable pad is configured to float upon the volume of fluid; and a water-directing element for receiving water from the volume of water in the cavity and flow the received water onto the riding surface.

17. The water attraction of claim 16 wherein the water-directing element is a nozzle.

18. The water attraction of claim 16 further comprising a drainage portion disposed at an upstream end of the tiding surface from the water-directing element for draining water after it has flowed onto the riding surface into the cavity.

* * * * *